US011618050B2

(12) United States Patent
Carriere et al.

(10) Patent No.: US 11,618,050 B2
(45) Date of Patent: Apr. 4, 2023

(54) WATER MODULES FOR ABOVE-GROUND SWIMMING POOLS

(71) Applicant: Groupe VIF Inc., Sainte-Hyacinthe (CA)

(72) Inventors: Thierry Carriere, Sainte-Hyacinthe (CA); Maxime Guay-Guillemette, Saint-Hyacinthe (CA); Véronique Lafond, Saint-Hyacinthe (CA); Carl Viens, Saint-Hyacinthe (CA)

(73) Assignee: Groupe VIF Inc., Sainte-Hyacinthe (CA)

( * ) Notice: Subject to any disclaimer, the term of this patent is extended or adjusted under 35 U.S.C. 154(b) by 616 days.

(21) Appl. No.: 16/655,870

(22) Filed: Oct. 17, 2019

(65) Prior Publication Data

US 2020/0122185 A1 Apr. 23, 2020

(30) Foreign Application Priority Data

Oct. 17, 2018 (CA) ..... CA 3021119

(51) Int. Cl.
*B05B 17/08* (2006.01)
*E04H 4/12* (2006.01)
*E04H 4/00* (2006.01)

(52) U.S. Cl.
CPC ..... *B05B 17/08* (2013.01); *B05B 17/085* (2013.01); *E04H 4/12* (2013.01); *E04H 4/005* (2013.01)

(58) Field of Classification Search
CPC ..... B05B 17/08; B05B 17/085; B05B 1/3402; B05B 9/0423; E04H 4/005; E04H 4/12; E04H 4/14
See application file for complete search history.

(56) References Cited

U.S. PATENT DOCUMENTS 3,318,528 A * 5/1967 Williams ..... B05B 17/08 4/496
5,115,974 A * 5/1992 Tobias ..... B05B 17/085 239/289
6,450,418 B1 * 9/2002 Simpson ..... E04H 4/148 239/22
2007/0107117 A1 * 5/2007 Casolco ..... E04H 4/12 4/496
2016/0222636 A1 * 8/2016 Gibson ..... E03C 1/048
2018/0147595 A1 * 5/2018 Vogtner ..... E04H 4/148

* cited by examiner

*Primary Examiner* — J C Jacyna

(74) *Attorney, Agent, or Firm* — Harness, Dickey & Pierce PLC

(57) ABSTRACT

An above-ground swimming pool is provided. The pool includes a bottom surface with side walls extending upwardly therefrom to define an inner volume for receiving water. The pool further includes top edge portions mounted on a top perimeter of the side walls and caps mounted between adjacent top edge portions. The pool also includes at least one water module adapted to connect to and operate with the above-ground swimming pool. The water module has a module base connectable to the top perimeter of the side wall of the swimming pool, a module casing extending upward from the module base and having a distal opening; and a supply system provided within the module casing and having a discharge opening for supplying water out of the supply system and through the distal opening of the module casing to enter an inner volume of the above-ground swimming pool.

20 Claims, 9 Drawing Sheets

WATER MODULES FOR ABOVE-GROUND SWIMMING POOLS

CROSS-REFERENCE TO RELATED APPLICATIONS

This application claims priority under 35USC§ 119(a) of CA Application No. 3.021.119, filed Oct. 17, 2018, entitled "WATER MODULES FOR ABOVE-GROUND SWIMMING POOLS", the entirety of which is hereby incorporated by reference.

TECHNICAL FIELD

The technical field generally relates to apparatus for producing water stream displays, and more particularly to water stream displays for above-ground swimming pools.

BACKGROUND

Various modules or accessories for swimming pools or spas are known in the art. These accessories can be used for decorative/ornamental purposes or for functional purposes such as for filling the pool with water. Known water modules include water jets for discharging water into the pool.

There are various challenges and needs particularly for above-ground swimming pools in terms of water modules and accessories.

SUMMARY

According to a first aspect, an above-ground swimming pool is provided. The swimming pool includes a bottom surface, side walls extending upwardly from the bottom surface to define an inner volume for receiving water, a plurality of top edge portions mounted on a top perimeter of the side walls, a plurality of caps mounted on the top perimeter of the side walls between adjacent top edge portions, at least one water module integratable with the top perimeter of the side walls for supplying water to the inner volume. The water modules includes a module base connectable to one of the top edge portions and/or caps, a module casing extending upward from the module base and having a distal opening, and a supply system provided within the module casing and having a discharge opening for supplying water out of the supply system and through the distal opening of the module casing to enter the inner volume of the above-ground swimming pool.

According to a possible embodiment, the module base is configured to replace one of the caps about the top perimeter and is shaped and sized to at least partially cover the top edge portions extending on either side thereof.

According to a possible embodiment, the supply system comprises a chamber having an inlet coupled to a water source via one or more conduits, and wherein the conduits are at least partially concealed by the module casing and module base.

According to a possible embodiment, the discharge opening is an outlet of the chamber.

According to a possible embodiment, the water modules includes a light-emitting device adapted to impart one or more colors to the supplied water.

According to a possible embodiment, the light-emitting device is connectable to the chamber of the supply system.

According to a possible embodiment, the supply system includes a diffuser mounted within the chamber of the supply system, the diffuser being adapted to reduce turbulence of the water flowing therethrough.

According to a possible embodiment, the module casing is fixedly connected to the module base.

According to a possible embodiment, the module casing is pivotally connected to the module base.

According to a possible embodiment, the distal opening of the module casing is shaped and sized such that the water flowing therethrough forms a water jet.

According to a possible embodiment, the distal opening of the module casing is shaped and sized such that the water flowing therethrough forms a waterfall.

According to a possible embodiment, the waterfall is a sheet waterfall.

According to a possible embodiment, the water module is adapted to supply the waterfall substantially in the center of the inner volume of the above-ground swimming pool.

According to a possible embodiment, the water module further includes a pressure system operatively connected to the supply system for controlling the pressure at which the water is supplied to the inner volume of the above-ground swimming pool.

According to a possible embodiment, the pressure system comprises a pump, a flow valve and a manifold, and wherein the conduits coupled to the inlet of the supply system are coupled to the manifold.

According to a possible embodiment, the at least one water module comprises a plurality of water modules in spaced-apart relation about the top perimeter of the side wall, and wherein the flow valve and manifold are adapted to control the pressure of each water module individually.

According to a second aspect, a water module connectable to and operable with an above-ground swimming pool is provided. The water module includes a module base connectable to a top perimeter of a side wall of the swimming pool, a module casing extending upward from the module base and having a distal opening and a supply system provided within the module casing and having a discharge opening for supplying water out of the supply system and through the distal opening of the module casing to enter an inner volume of the above-ground swimming pool.

According to a possible embodiment, the module base is configured to replace a structural element of the above-ground swimming pool about the top perimeter of the side wall.

According to a possible embodiment, the supply system comprises a chamber having an inlet coupled to a water source via conduits, and wherein the conduits are at least partially concealed by the module casing and module base.

According to a possible embodiment, the discharge opening is an outlet of the chamber.

According to a possible embodiment, the above-ground swimming pool water module further includes at least one light-emitting device adapted to impart one or more color to the discharged water.

According to a possible embodiment, the light-emitting device is connected to the chamber of the supply system.

According to a possible embodiment, the supply system comprises a diffuser mounted within the chamber of the supply system, the diffuser being adapted to reduce turbulence of the water flowing therethrough.

According to a possible embodiment, the module casing is fixedly connected to the module base.

According to a possible embodiment, the module casing is pivotally connected to the module base.

According to a possible embodiment, the distal opening of the module casing is shaped and sized such that the water flowing therethrough forms a substantially tubular water jet.

According to a possible embodiment, the distal opening of the module casing is shaped and sized such that the water flowing therethrough forms a waterfall.

According to a possible embodiment, the waterfall is a sheet waterfall.

According to a possible embodiment, the water module is adapted to supply the waterfall substantially in the center of the above-ground swimming pool.

According to another aspect, a method of supplying a water jet or waterfall into an above-ground swimming pool is provided. The method includes mounting one or more of the water module as defined above to a top perimeter of the side walls of the above-ground swimming pool and activating the water module to receive water therein and discharge water into the above-ground swimming pool.

According to a possible embodiment, the method further includes coupling the one or more water module to a pressure system for controlling the pressure at which the water is supplied to the inner volume of the above-ground swimming pool.

According to a possible embodiment, the pressure system comprises a pump, a flow valve and a manifold for controlling the pressure of each water module individually.

DETAILED DESCRIPTION

Above-ground swimming pools can be built as a free-standing structure, such as traditional home pools installed in private yards, or built as part of a separate structure, such as a building. It is appreciated that above-ground swimming pools can be built-in for long periods of time (e.g., months, years, etc.) or assembled and disassembled after summer for example. In the context of the present disclosure, the expression "above-ground swimming pools" generally refers to above-ground swimming pools having a permanent, or semi-permanent structure adapted to last up to 15 or 20 years before giving out and/or needing to be replaced. However, it is appreciated that the expression "above-ground swimming pool" can encompass any other suitable type of swimming pools with which the described embodiments could be used and may be useful. For this reason, the term "above-ground swimming pool" as used herein should not be taken as to limit the scope of the present disclosure as being used with permanent above-ground swimming pool in particular.

Figure 1:
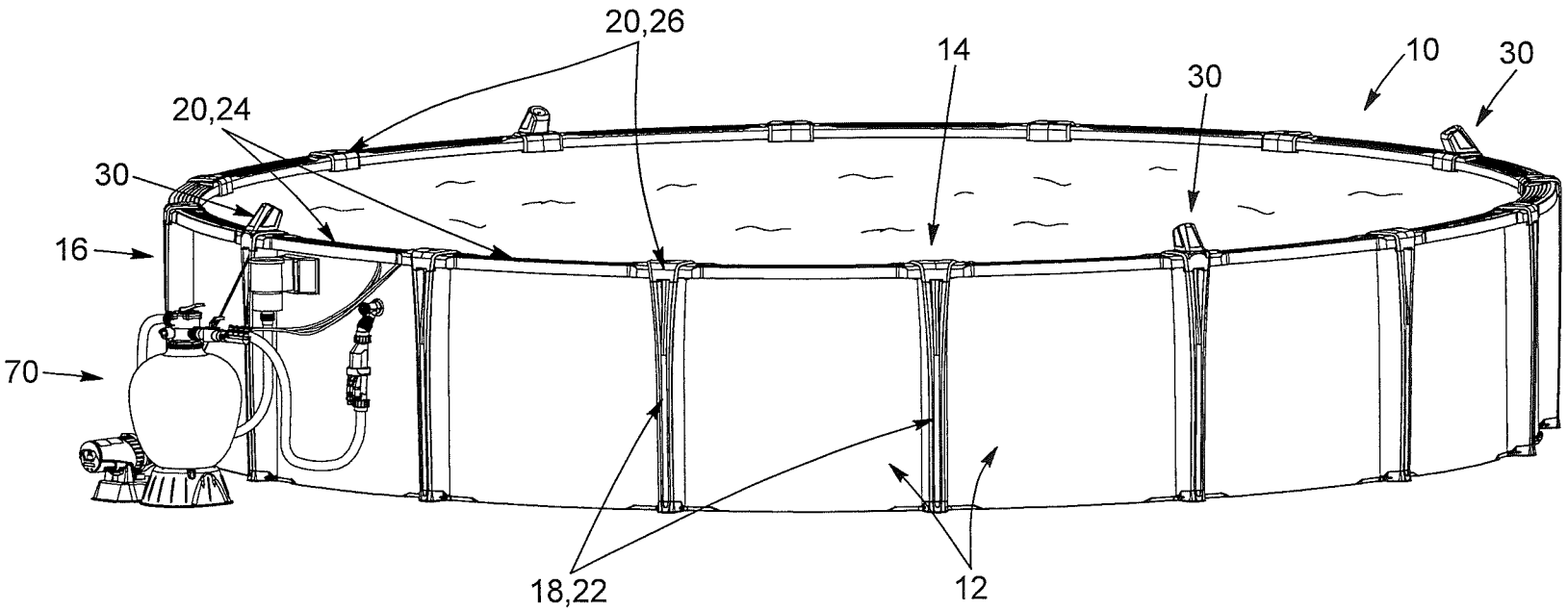
FIG. 1 is a representation of an above-ground swimming pool, showing various components thereof.
Figure 2:
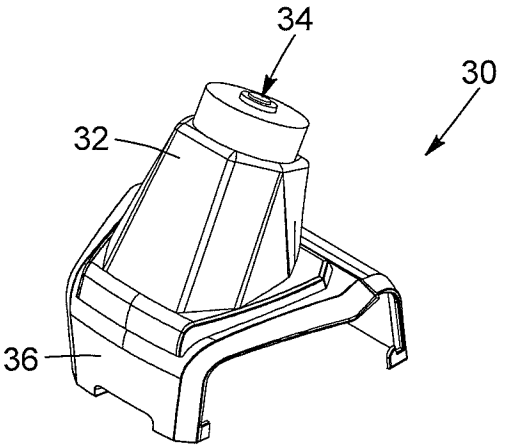
FIGS. 2 and 3 are top perspective views of water modules in accordance with two different embodiments.
Figure 3:
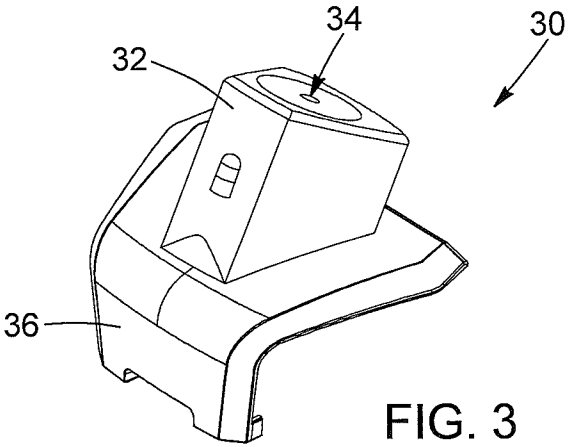
Figure 4:
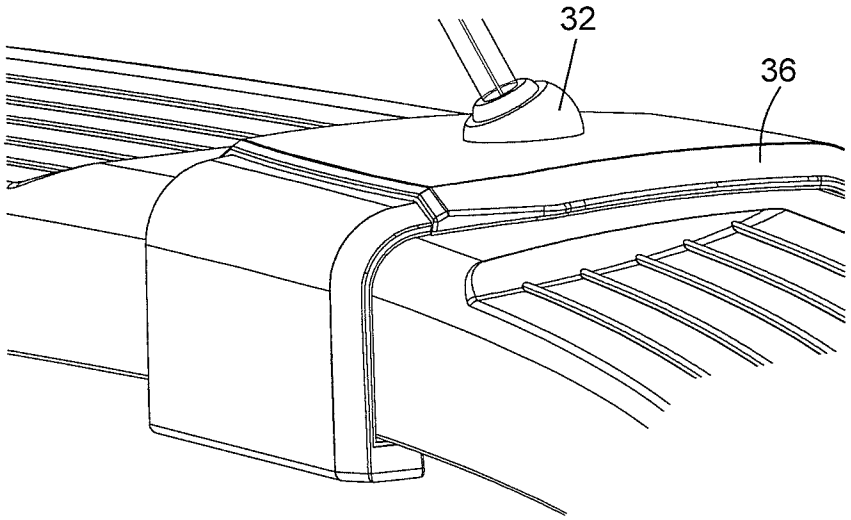
FIG. 4 is a perspective view of a water module in accordance with an embodiment, showing a spherical module casing.

Referring to FIG. 1, a schematic representation of an above-ground swimming pool 10 (hereafter simply "pool") is shown. As should be readily understood, the pool 10 includes a pool wall 12 shaped and configured for defining a periphery of the pool 10. In the illustrated embodiment, the pool wall 12 defines a closed periphery which in turn defines an inner receptacle 14 for filling with water. The pool wall 12 can be positioned to define an inner receptacle 14 having any suitable shape, such as circular, ovoid, rectangular or square, for example. In some embodiments, the pool wall 12 is made of galvanized steel, although it is appreciated that the pool wall 12 can be made of any other suitable material, such as aluminium for example.

In some embodiments, the pool wall 12 can be reinforced for retaining and safely containing the weight of the water filling the inner receptacle 14. The pool 10 can be provided with a frame 16 coupled to the pool wall 12 for securing the pool wall 12 in place and for providing additional strength to the pool wall 12. In the present embodiment, the frame 16 includes a plurality of structural elements 18 coupled to the pool wall 12 at various locations combined with a plurality of ornamental elements 20. More specifically, the frame 16 includes a plurality of posts 22 installed at predetermined intervals around the pool wall 12. The posts 22 extend from the ground toward the top perimeter of the pool wall 12 in a substantially vertical manner for increasing the strength of the pool wall 12.

In addition, the structural elements 18 can include top tracks, or rails (not shown) coupled to the top perimeter of the pool wall 12, and extending therealong around the periphery of the pool 10. Each top rail can be shaped and sized to extend between two adjacent posts 22 and are adapted to stabilize the pool wall 12 between said corresponding posts 22. Furthermore, the structural elements 18 can include coupling elements adapted to effectively couple two or more components to one another. For example, in the present embodiment, the coupling elements include a plurality of top plates (not shown) attached to the top end of each post 22. The top plates are adapted to have the top rails connect thereto. In other words, each top plate is adapted to define a connection point between each post 22 and the corresponding pair of top rails extending on either side thereof.

As previously mentioned, the frame 16 further includes ornamental elements 20. In the present embodiments, and as should be readily understood by a person skilled in the art, the ornamental elements 20 can include a plurality of top edge portions 24 coupled to the top perimeter of the pool wall 12 for covering the top rails. The ornamental elements 20 can further include a plurality of caps 26 positioned atop the posts 22 for covering the top plates and the various connections between the structural elements 18. It is appreciated that the top edge portions 24 and caps 26 can provide additional strength to the pool wall 12 while also providing a more finished look to the pool 10. In some embodiments, each top edge portion 24 connects to the top perimeter of the pool wall 12 between a pair of adjacent posts 22 (similarly to the top rails). It is appreciated that the top edge portions 24 can be further connected to the top plates for additional security, for example. The caps 26 can then be installed over the top plates, and thus also cover the corresponding ends of the top edge portions 24 connecting to said top plate. It should be readily understood that the pool can include additional structural and/or ornamental elements which are not discussed in the present disclosure.

As will be explained below in relation to various embodiments, water modules for above-ground swimming pools are disclosed. It should be understood that, as used herein, the expression "water module" refers to an apparatus configured to create various water streams for providing water to the pool and can be referred to as "fountains" as well. The water modules can be provided around the periphery of a corresponding above-ground swimming pool for providing water thereto. Each water module can be shaped and configured to be an integrated component of the structure of the pool. It should be understood that, as used herein, the expression "integrated component", or any derivative or similar expression thereof, refer to a component of the pool which is included in the construction of the swimming pool, such as the pool wall 12 or frame 16 described above, for example. In other words, the water modules can include elements adapted to cooperate with the structural and/or ornamental elements 18, 20 of the pool 10, such as the posts 22 (on top or along a length thereof inside or outside the pool), the edge portions 24, the caps 26 or any other suitable location.

In some embodiments, the water modules can be shaped and sized to be coupled between two elements of the frame 16. In other embodiments, the water modules can include components adapted to partially or completely replace one or more elements of the frame 16. In some embodiments, the water module can have the same texture, be composed of the same material, and/or have the same colour as the other components of the swimming pool (e.g., caps and top edge portions) to provide a relatively seamless effect.

The water modules can be provided with various types of water outlets, such as nozzles and/or spouts, adapted to provide water to the pool 10. For example, the water modules can include one or more water outlets shaped and sized to produce water jets, waterfalls or any other types of sprays and water discharge patterns. It should be understood that, as used herein the expression "water jet" generally refers to a substantially tubular stream of water, although other types of water streams are possible. For this reason, the expression "water jet", as used herein, should not be taken as to limit the scope of the present disclosure as limiting the type of water stream to a tubular and/or laminar stream of water, but should encompass any other suitable type of streams with which the described embodiments could be used and may be useful. In some embodiments, the water modules can be provided with interchangeable inserts adapted to modify the type of water stream, such as an insert with a single hole to form the aforementioned tubular jet or waterfall, or an insert with a plurality of holes to form a mist or spray mimicking rain, for example.

It should be readily understood that the water modules include conduits coupled between a water source and the water outlets for allowing each module to produce a respective stream of water (e.g., jets and/or waterfalls). Generally, the water source is the water found within the receptacle of the pool 10 itself. However, it is appreciated that the water source coupled to the water modules can be an external water source. Additionally, the water modules can be coupled to and/or cooperate with light emitting devices for imparting one or more colors to the water streams produced, therefore enhancing the visual effect created by the water modules. As will be described further below in relation to various example embodiments, the water modules are shaped and sized to cooperate with the structure of the pool 10 (e.g., posts 22, top edge portions 24, etc.) to at least partially conceal the conduits providing water to the water module and/or power cables providing electricity to the light emitting devices. As such, the addition of one or more water modules does not disrupt the finished look of the pool 10 produced by the ornamental elements.

With reference to FIGS. 2 to 6*b*, and with continued reference to FIG. 1, various embodiments of a water jet module 30 are shown. In the present embodiment, the water jet module 30 includes a module casing 32 provided with an outlet 34 such as a nozzle or spout, for example, for allowing water to exit therefrom. The water jet module 30 further includes a module base 36 adapted to be connected to the pool 10. The module casing 32 is illustratively coupled to the module base 36, effectively securing the module casing 32 to the pool 10. In some embodiments, the module casing 32 can be positioned at any suitable angle for providing water to the receptacle 14. More specifically, in some embodiments, the angle of the module casing 32 with respect to the module base 36 can be adjusted, either prior to installation, during installation or after installation. It is appreciated that the water modules producing water jets are traditionally aimed upwardly for creating an arc of water over the water surface. In some embodiments, the module body 32 can be pivotally or swivellably connected to the module base 36, effectively allowing adjustment of the angle of the water stream when desired. For example, the module casing 32 can have a spherical shape (FIG. 4) and be connected to the module base 36 via a spherical bearing. In some embodiments, the module casing 32 can be positioned for emitting water upwardly (e.g., straight up) or towards the pool inner receptacle 14 by positioning the module body 32 at a downward angle. However, it is appreciated that other configurations of the water jet modules 30 are possible for allowing adjustment of the angle of the water stream.

Figure 5B:
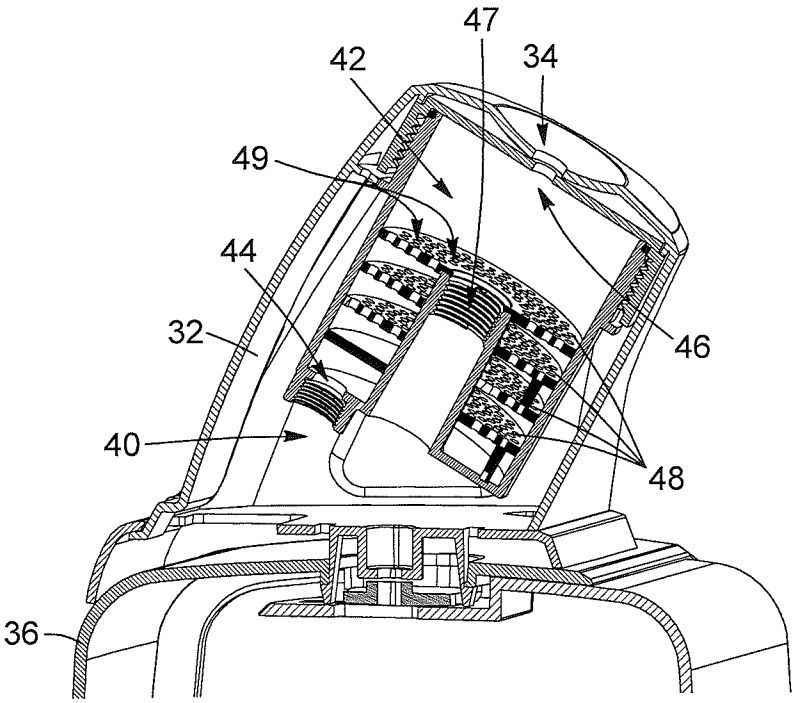
FIG. 5*b* is a sectional view of the water module shown in FIG. 5*a*, showing a supply system for producing the water stream.
Figure 6A:
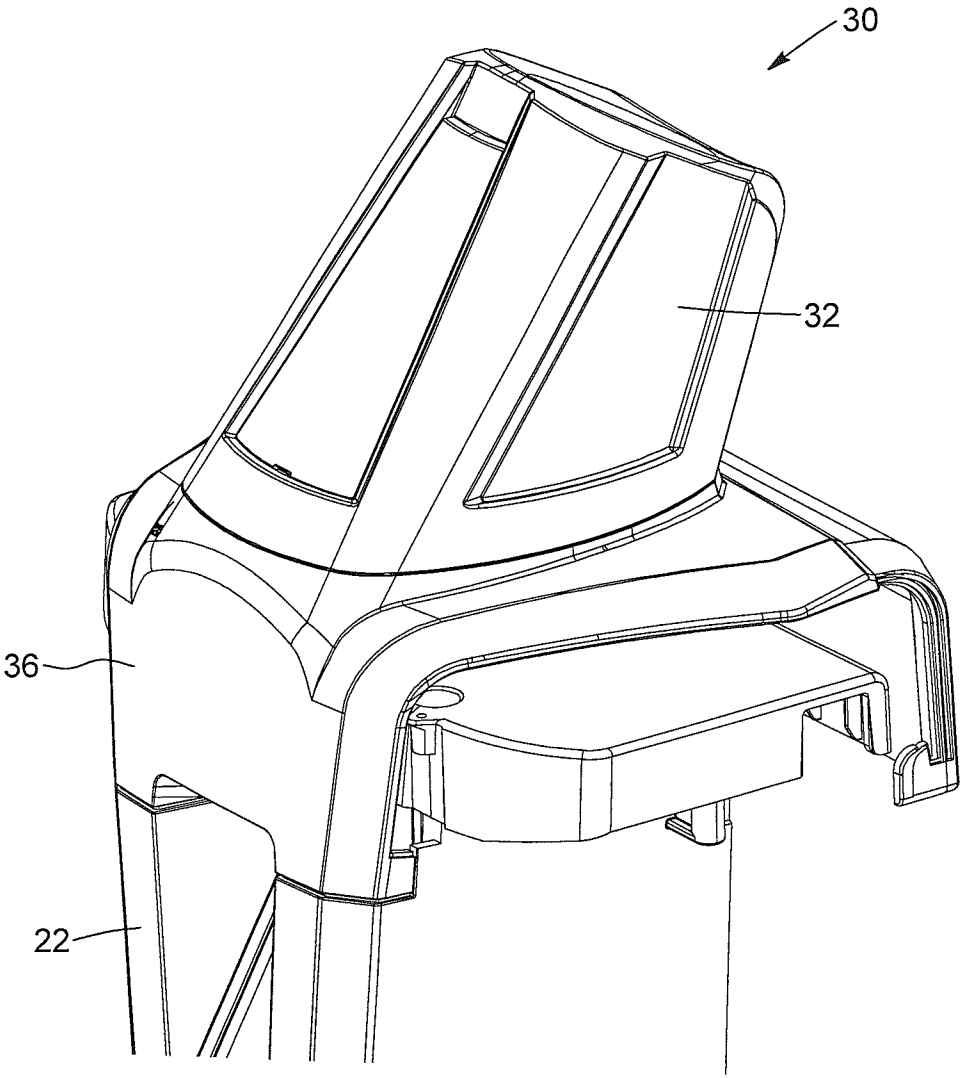
FIG. 6*a* is a top perspective view of a water module in accordance with another embodiment, showing the water jet module connected to a post of the above-ground pool.
Figure 6B:
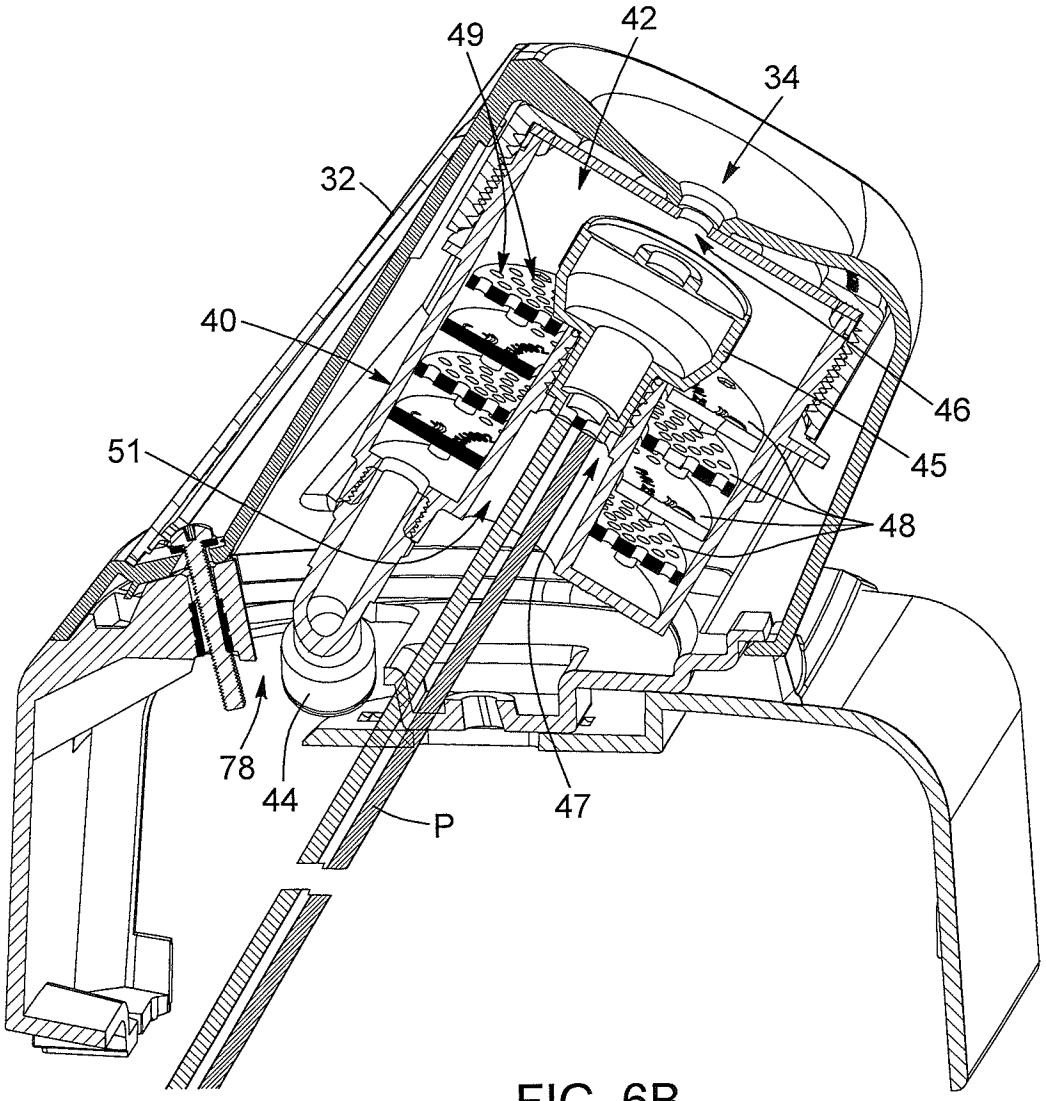
FIG. 6*b* is a sectional view of the water module shown in FIG. 6*a*, showing a supply system for producing the water stream and a light-emitting device disposed within the water module.

Referring more specifically to FIGS. 5*b* and 6*b*, the module casing 32 can be shaped and sized to house a supply system 40 coupled to the water source and being adapted to produce the water stream. The supply system 40 includes a chamber 42 having an inlet 44 for allowing water to fill the chamber 42. The chamber 42 further includes an outlet 46 position to communicate with the outlet 34 of the module casing 32. It should be understood that the water source can be connected to the chamber 42 for providing water thereto via the inlet 44. Once the chamber 42 is filled, the water can exit through the outlet 46 to produce the water stream. Furthermore, the supply system 40 can be provided with a secondary outlet positioned within the chamber 42 to prevent pressure build-up within the chamber 42 due to water entering the chamber 42 faster than it is being discharged, for example.

The supply system 40 can further include a diffuser for reducing the velocity of the water passing through the chamber 42. It should be understood that the diffuser can be adapted to reduce the turbulence of the flow of water, therefore creating a laminar flow as the water exits through the outlet 46. In the present embodiments, the diffuser includes one or more diffuser plates 48 arranged subsequently on respective planes within the chamber 42. It is appreciated that the diffuser plates 48 can be connected to the chamber 42, to each other, or a combination of both. In addition, it is noted that the diffuser plates 48 are substantially parallel to one another, although other configurations are possible.

In the present embodiment, the diffuser plates 48 are respectively provided with apertures 49 for allowing the water to flow therethrough. The apertures 49 can be provided in any suitable formation/configuration, for example in side-by-side rows around the surface of the diffuser plates 48. Each diffuser plate 48 can have the same number of apertures 49, although it is appreciated that the number of apertures 49 can vary from one diffuser plate 48 to the other. In some embodiments, the apertures 49 can be all of the same size, such as 0.125 inches in diameter, for example. It is appreciated that the apertures 49 can have any other suitable size, for example the diameter of the apertures 49 can be between 0.1" and 0.5". In some embodiments, the size of the apertures 49 can vary between diffuser plates 48 and/or among the apertures 49 of a same diffuser plate 48.

As mentioned above, the water modules can cooperate with a light-emitting device 45 to enhance the visual effect of the water stream. Referring more specifically to FIG. 6*b*, the chamber 42 of the supply system 40 can be provided with a rear opening 47 adapted to receive such a light-emitting device 45. It is appreciated that the rear opening 47 is aligned with the outlet 46 for allowing light to exit the chamber 42, thus imparting color to the water stream. In some embodiments, the rear opening 47 is threaded to facilitate connection with the light-emitting device 45. As seen in FIG. 6*b*, a power cable (P) extends through the module base 36 and within the module casing 32 to connect to the light-emitting device 45 coupled to the rear opening 47. In this embodiment, the chamber 42 of the supply system 40 is provided with a channel 51 extending from the rear opening 47 for receiving the power cable (P) and at least partially isolating the power cable from the rest of the inner chamber 42. As such, it is appreciated that the power cable (P) can be isolated from portions of the water module which can be flooded (e.g., the chamber 42) or where water can be provided. In the event that the light-emitting device 45 is not required (or wanted), the rear opening 47 can be simply plugged to prevent water from exiting the inner chamber 42 via said rear opening 47.

Figure 5A:
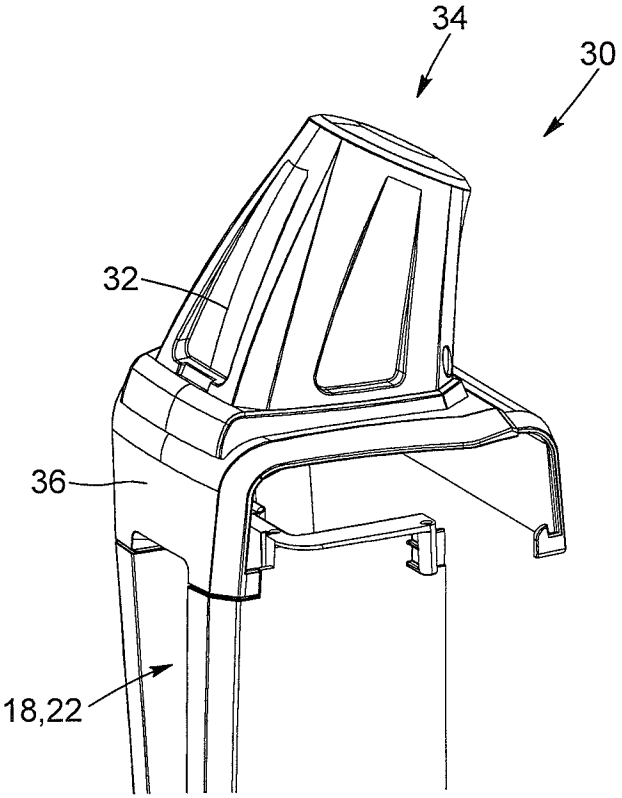
FIG. 5*a* is a top perspective view of a water module in accordance with another embodiment, showing the water module connected to a post of the above-ground pool.

Referring more specifically to FIGS. 1, 5*a* and 6*a*, the module base 36 can be adapted to be connected to one of the posts 22 of the frame 16. More specifically, the module base 36 is adapted to connect to the top end of the post 22, in a similar fashion as the caps 26 previously described. In some embodiments, the module base 36 can be connected to the post 22 using mechanical fasteners or via snap-fit connections, although other connection methods and/or devices are possible. Additionally, the module base 36 can be shaped and sized to at least partially conceal the corresponding top plate and the ends of the top edge portions 24 connected thereto. It is appreciated that, in this embodiment, the module base 36 can be an integrated component of the frame 16 of the pool 10 and effectively replace one of the caps 26. More specifically, the module base 36 can be shaped and sized to be installed over the top plates defining connection points between each post 22 and the corresponding pair of rails extending on either side thereof. Therefore, the module base 36 can cover the corresponding ends of the top edge portions 24 connecting to said top plate. The module base 36 can have gripping portions adapted to effectively grip adjacent components around the top perimeter of the swimming pool (e.g., top rails, top edge portions 24, etc.). However, it is appreciated that the module base 36 can have any suitable shape and size, and be connected to the pool 10 in any other suitable manner.

Figure 7:
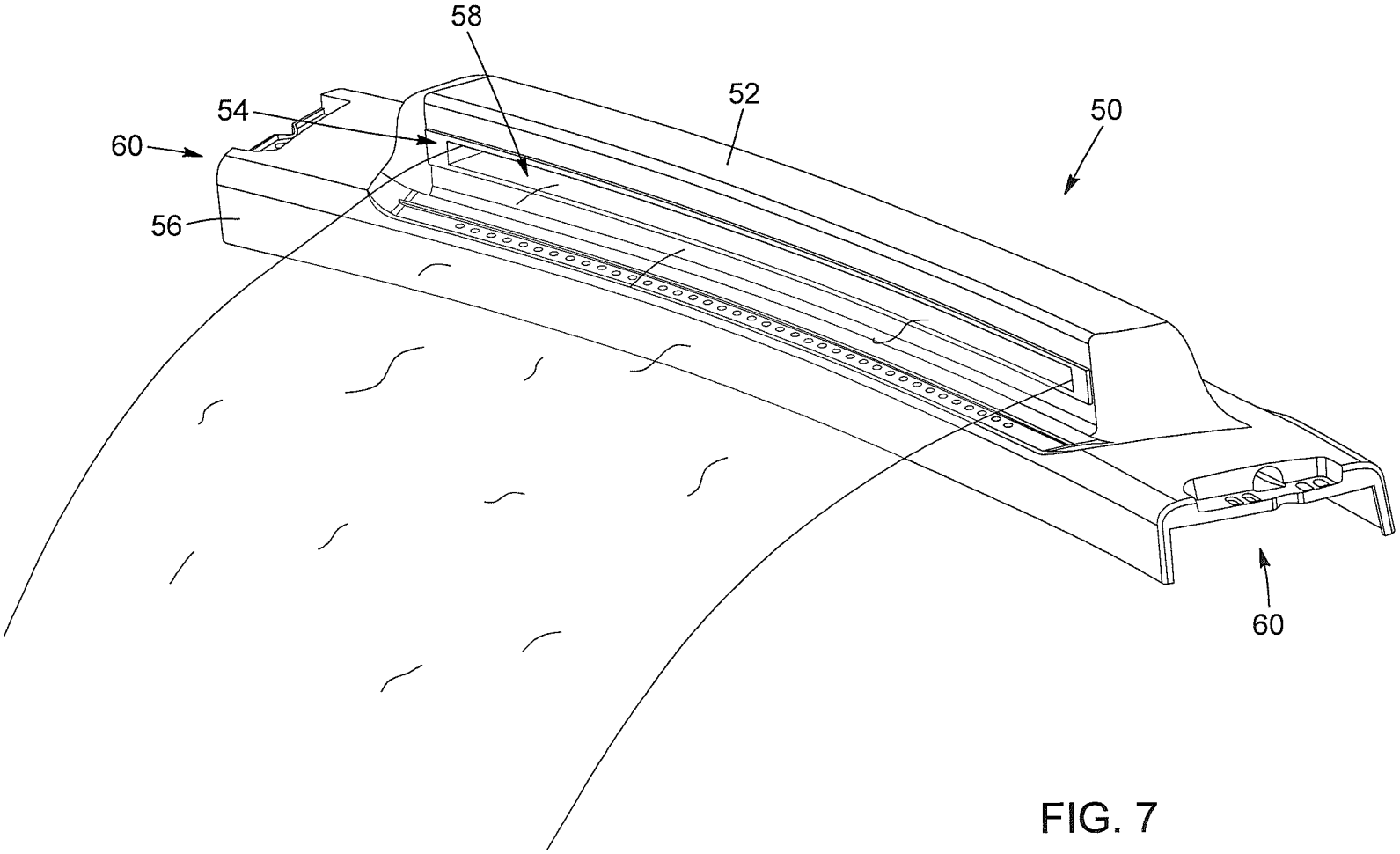
FIG. 7 is a perspective view of a waterfall module producing a sheet-like waterfall, in accordance with a possible embodiment.
Figure 8:
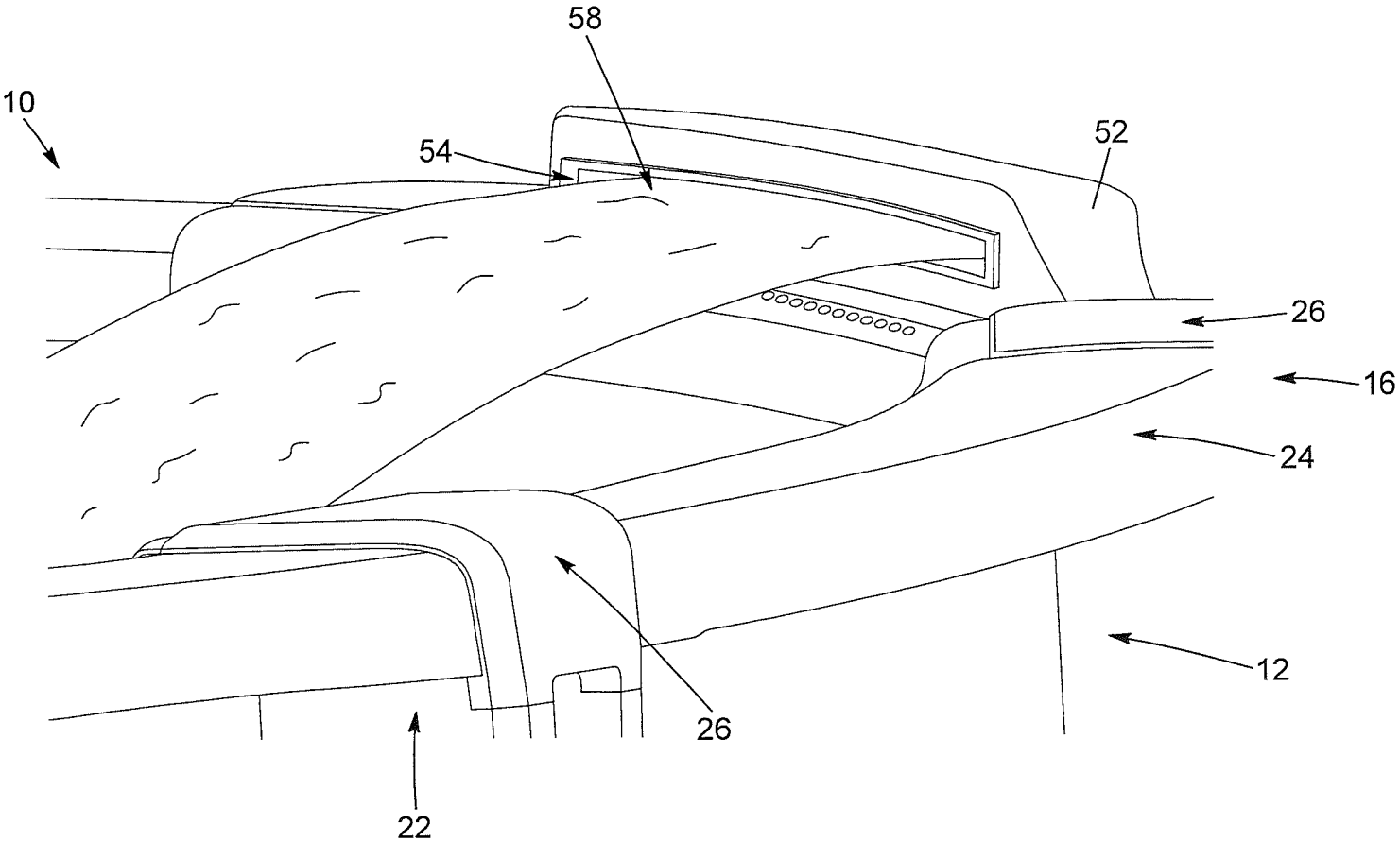
FIG. 8 is a perspective view of a waterfall module connected to the above-ground pool wall, in accordance with an embodiment.

Now referring to FIGS. 7 and 8, waterfall modules 50 according to various exemplary embodiments are shown. It is appreciated that, for ornamental purposes, the waterfall module 50 is adapted to produce water streams known in the art as "sheet waterfalls" defined by an elongated and laminar stream of water. However, it is further appreciated that the waterfall module 50 can be adapted to produce any other type of water stream and or type of waterfall.

In a similar fashion as the above-described water jet modules, the waterfall module 50 includes an elongated module casing 52 provided with an elongated outlet 54 for allowing water to exit therefrom. The waterfall module 50 further includes an elongated module base 56 adapted to be connected to the pool 10. In addition, the module casing 52 is coupled to the module base 56, effectively securing the module casing 52 to the pool 10, as illustrated in FIG. 8. In some embodiments, the module casing 52 can be fixedly connected to the module base 56, which can be in turn fixedly connected to the pool 10. However, it is appreciated that the module casing 52 and/or module base 56 can be coupled to one another and/or to the pool 10 in a manner allowing adjustment of the position and/or orientation thereof. It is further appreciated that the waterfall modules traditionally produce a water stream (e.g., sheet waterfall) in a manner such that the water freefalls into the pool to create an effect which can be pleasing to the eyes and restful to the ears.

The module casing 52 can be shaped and sized to house a waterfall supply system coupled to the water source and being configured to produce the water stream (i.e., the waterfall). Similarly to the supply system described in relation with the water jet module, the waterfall supply system can include an elongated chamber having an inlet for allowing water to fill the chamber. The chamber can further include an elongated outlet 58 positioned to communicate with the outlet 54 of the module casing 52. It should be understood that the water source can be connected to the chamber for providing water thereto, and that once the chamber is filled, the water can exit through the elongated outlet 58 to produce the sheet waterfall. It should be noted that the waterfall supply system can also include a secondary outlet for preventing overflow of the chamber and/or pressure build-up within said chamber. Furthermore, the waterfall supply system can include a diffuser for reducing the velocity of the water flowing through the chamber and facilitate the production of a laminar stream exiting the outlet 58.

Still referring to FIGS. 7 and 8, the module base 56 of the waterfall module 50 can be adapted to be connected to the pool wall 12. More specifically, the module base 56 is adapted to connect to the top perimeter of the pool wall 12, in a similar fashion as the top edge portions 24 previously described. In other words, the module base 56 is connectable between two adjacent posts 22 of the frame 16. In some embodiments, the module base 56 includes lateral coupling sections 60 (FIG. 7) at either ends thereof for connecting to a respective top plate and/or cap 26 of the frame 16. The lateral coupling sections 60 can be connected to the top plates using any suitable mechanical fasteners such as screws or bolts for example. However, it is appreciated that other connection methods and/or devices are possible, such as connecting the lateral coupling sections 60 via snap-fit connections for example. It should be understood that, in this embodiment, the module base 56 can be an integrated component of the frame 16 of the pool 10 and effectively replace one of the top edge portions 24. However, it is appreciated that the module base 56 can be connected to the pool 10 in any other suitable manner.

Figure 9:
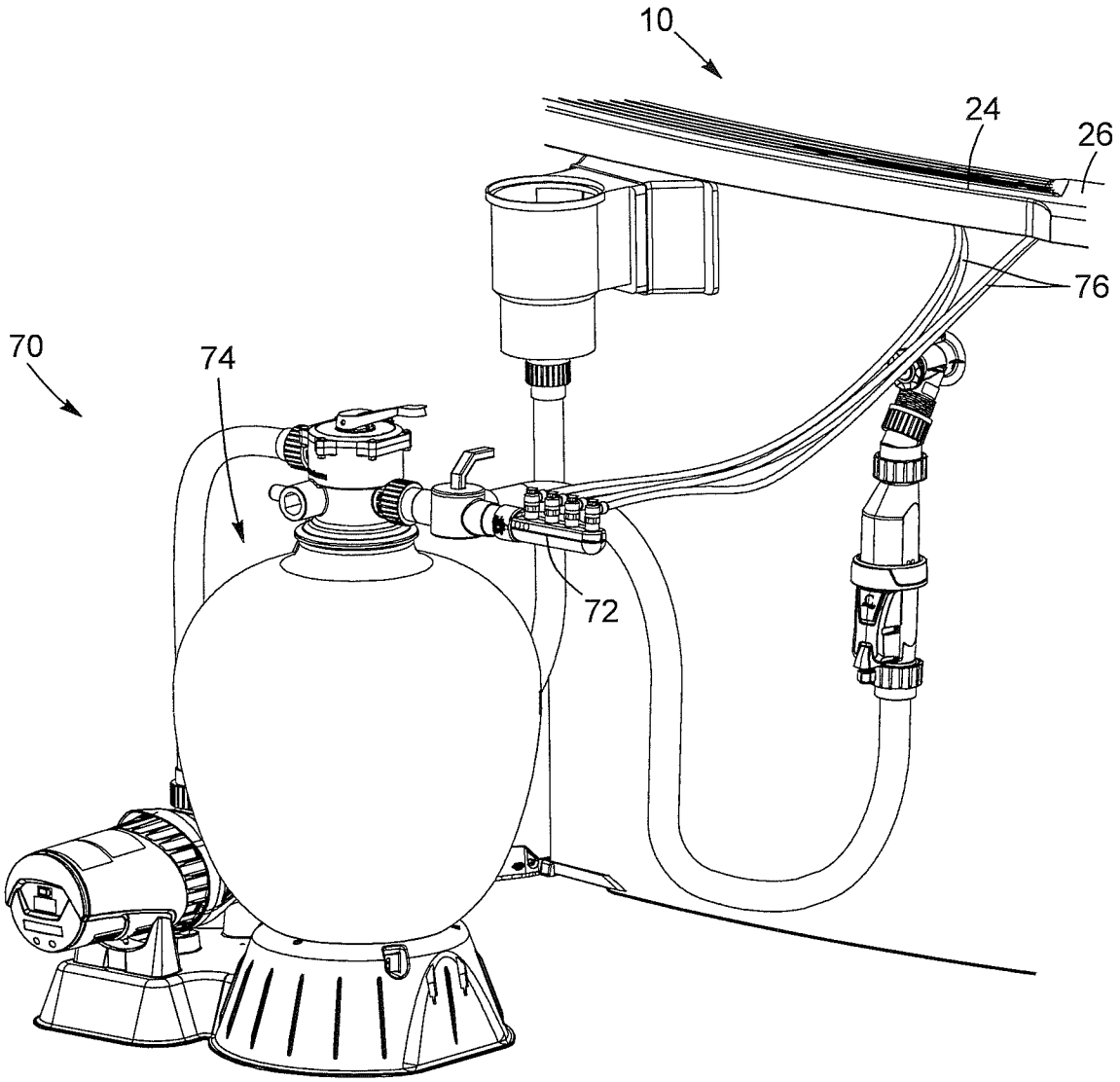
FIG. 9 is a persecptive view of a pressure system according to an embodiment, showing a pump coupled to water conduits.
Figure 10:
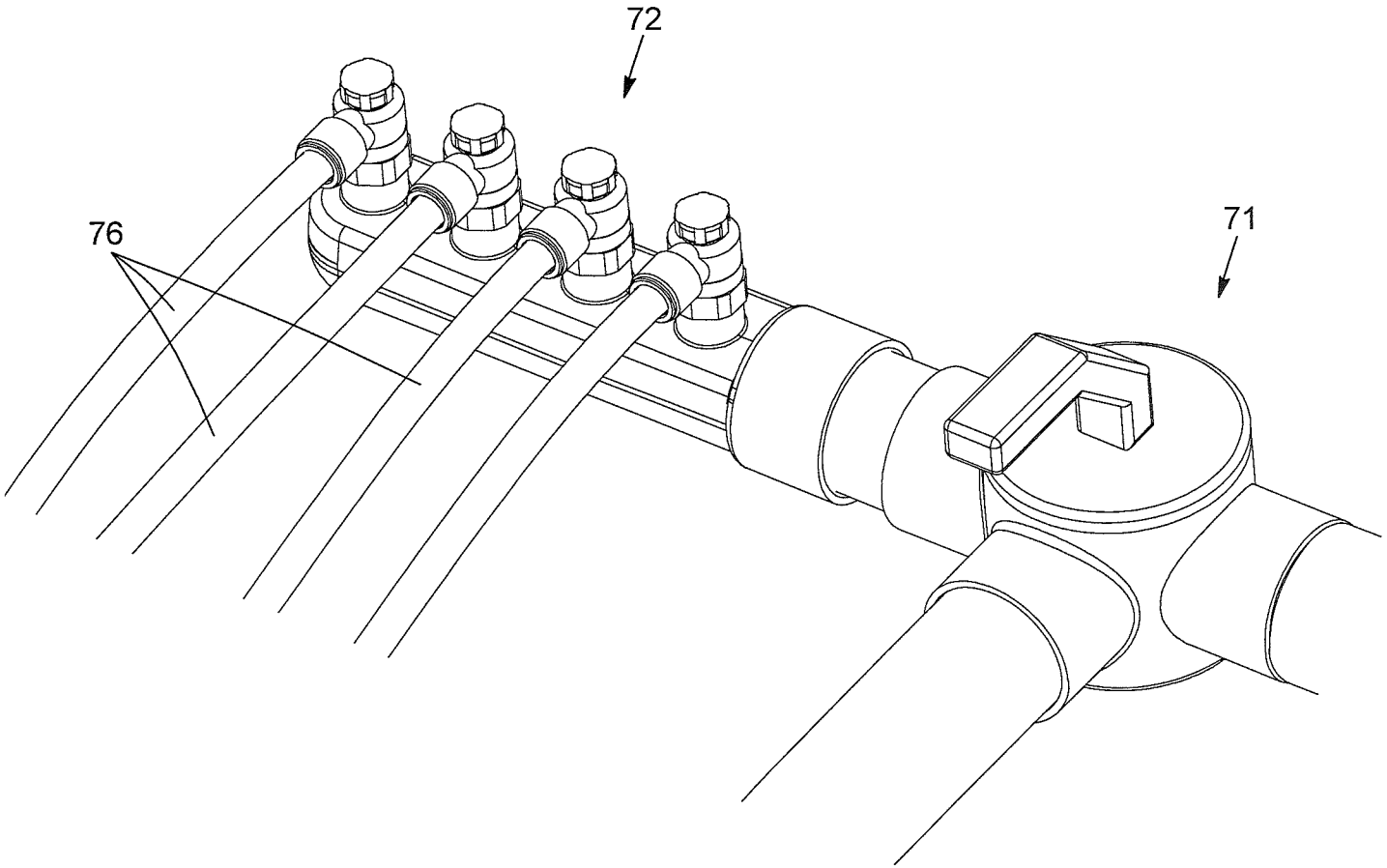
FIG. 10 is an enlarged view of a manifold according to an embodiment, showing a single conduit split into four separate water conduits.

With reference to FIGS. 1, 9 and 10, the water modules can cooperate with a pressure system 70 adapted to control/adjust the rate at which water is discharged into the inner volume of the swimming pool. In other words, the pressure system 70 can be adapted to control the pressure at which the water stream (e.g., water jet) is produced. In some embodiments, and as seen in FIGS. 9 and 10, the pressure system 70 can include a flow valve 71 and/or a manifold 72, coupled between a pump 74 and water conduits 76 for adjusting the pressure of the water streams produced by each water module. In this embodiment, the manifold 72 can be adapted to control the pressure of the water flowing through each water conduit 76, and therefore through each water module, individually, i.e., independently from one another. It should be readily understood that increasing the pressure (i.e., opening the flow valve 71) causes the water stream to exit the outlet of the module casing at greater velocities, thus travelling longer distances (e.g., higher in the air and/or further across the pool 10).

In this embodiment, the water conduits 76 extend underneath the edge portions 24 and/or the caps 26 about the pool perimeter to connect to respective water modules. Referring back to FIG. 6*b*, the module base 36 can be provided with an aperture 78 extending through a thickness thereof and communicating with the supply system 40 provided within the module casing 32. In this embodiment, the inlet 44 of the supply system extends through the aperture 78 to facilitate connection of the water conduit 76 to the inlet 44 for providing water to the chamber 42 of the supply system 40. It is appreciated that having the water conduits 76 extend below the edge portions 24 and/or caps 26 can at least partially hide the conduits 76 about the top perimeter of the pool. As such, the ornamental and decorative features of the structure of the swimming pool are not obstructed by the presence of the water conduits 76. However, it is appreciated that other methods and/or devices are possible for providing water to the water modules, or for adjusting the pressure within the water conduits 76.

It should be understood from the above disclosure that the various embodiments described herein provide water modules configured to be connected to an above-ground swimming pool. More particularly, the water modules can be an integrated component of the structure of the pool by either replacing known structural elements or cooperating therewith in a substantially seamless manner. As such, the connection of one or more water modules does interrupt the finished look of the swimming pool. It should be noted that the swimming pools described within the present disclosure are above-ground swimming pools, although it is appreciated that the water modules described herein can be implemented in other types of swimming pools.

While the above description provides exemplary embodiments of above-ground swimming pool water modules, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications are possible.

In the above description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

In addition, although the optional configurations as illustrated in the accompanying drawings comprises various components and although the optional configurations of the water modules as shown may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperations thereinbetween, as well as other suitable geometrical configurations may be used for the water modules, and corresponding parts, as briefly explained and as can be easily inferred herefrom, without departing from the scope of the disclosure.

The invention claimed is:

1. An above-ground swimming pool comprising:

a bottom surface;

side walls extending upwardly from the bottom surface to define an inner volume for receiving water, the side walls having respective top edges defining a top perimeter;

a rail connected to the side walls about the top perimeter, the rail comprising a plurality of top edge portions connectable to the top edges of the side walls, and a plurality of caps of connectable to the top edges between adjacent top edge portions;

at least one water module integratable with the rail and adapted to supply water to the inner volume, comprising:

a module base adapted to replace at least one component of the rail;

a module casing extending from the module base and having an interior volume and a distal opening defined at a distal end thereof and communicating with the interior volume; and a supply system provided within the interior volume of the module casing and adapted to be coupled to a water source to receive water therefrom, the supply system having a discharge opening in fluid communication with the distal opening of the module casing to enable supplying the water to the inner volume of the above-ground swimming pool.

2. The above-ground swimming pool according to claim 1, wherein the module base is configured to replace one of the caps and is shaped and adapted to be connected to and at least partially cover the top edge portions extending on either side thereof.

3. The above-ground swimming pool according to claim 1, wherein the supply system comprises a chamber having an inlet coupled to the water source via one or more conduits, and wherein the conduits are at least partially concealed by the module casing and the module base.

4. The above-ground swimming pool according to claim 3, wherein the discharge opening is an outlet of the chamber.

5. The above-ground swimming pool according to claim 3, wherein the water module includes a light-emitting device connectable to the chamber of the supply system and being adapted to impart one or more colors to the supplied water.

6. The above-ground swimming pool according to claim 3, wherein the supply system comprises a diffuser mounted within the chamber of the supply system, the diffuser being adapted to reduce turbulence of the water flowing through the chamber and toward the discharge opening.

7. The above-ground swimming pool according to claim 1, wherein the distal opening of the module casing is shaped and sized such that the water flowing therethrough forms a water jet.

8. The above-ground swimming pool according to claim 1, wherein the distal opening of the module casing is shaped and sized such that the water flowing therethrough forms a waterfall.

9. The above-ground swimming pool according to claim 8, wherein the water module is adapted to supply the waterfall substantially in the center of the inner volume of the above-ground swimming pool.

10. The above-ground swimming pool according to claim 3, wherein the water module further comprises a pressure system operatively connected to the supply system and being operable to control the pressure at which the water is supplied to the inner volume of the above-ground swimming pool.

11. The above-ground swimming pool according to claim 10, wherein the pressure system comprises a pump, a flow valve and a manifold, and wherein the conduits coupled to the inlet of the supply system are coupled to the manifold.

12. The above-ground swimming pool according to claim 11, wherein the at least one water module comprises a plurality of water modules in spaced-apart relation about the top perimeter of the side wall, and wherein the flow valve and manifold are adapted to control the pressure of each water module individually and independently from one another.

13. A water module connectable to and operable with an above-ground swimming pool having a side wall with a top rail extending along a top perimeter thereof and comprising a plurality of top edge portions and a plurality of caps, the water module comprising:

a module base integratable with the top rail of the above-ground swimming pool and adapted to replace at least one top edge portion of the plurality of top edge portions or at least one cap of the plurality of caps of the top rail of the side wall;

a module casing extending upward from the module base and having an interior volume and a distal opening defined at a distal end thereof and communicating with the interior volume; and a supply system provided within the interior volume of the module casing and adapted to be coupled to a water source to receive water therefrom, the supply system having a discharge opening in fluid communication with the distal opening of the module casing to enable supplying the water to an inner volume of the above-ground swimming pool.

14. The above-ground swimming pool water module according to claim 13, wherein the supply system comprises a chamber having an inlet coupled to the water source via conduits such that water flows into the chamber via the inlet, and wherein the conduits are at least partially concealed by the module casing and module base.

15. The above-ground swimming pool water module according to claim 14, wherein the discharge opening is an outlet of the chamber configured to enable the water within the chamber to exit the chamber and flow through the distal opening and into the inner volume of the above-ground swimming pool.

16. The above-ground swimming pool water module according to claim 14, further comprising at least one light-emitting device provided within the chamber of the supply system and being adapted to impart one or more color to the water flowing through the discharge opening.

17. The above-ground swimming pool water module according to claim 14, wherein the supply system comprises a diffuser mounted within the chamber of the supply system, the diffuser being adapted to reduce turbulence of the water flowing through the chamber and toward the discharge opening.

18. The above-ground swimming pool water module according claim 13, wherein the distal opening of the module casing is shaped and sized such that the water flowing therethrough forms a water jet.

19. The above-ground swimming pool water module according claim 13, wherein the distal opening of the module casing is shaped and sized such that the water flowing therethrough forms a waterfall.

20. A method of supplying a water jet or waterfall into an above-ground swimming pool, comprising mounting one or more of the water module as defined in claim 16 to a top perimeter of the side walls of the above-ground swimming pool and activating the water module to receive water therein and discharge water into the above-ground swimming pool.

* * * * *